US007321256B1

(12) United States Patent
Vasudevan

(10) Patent No.: US 7,321,256 B1
(45) Date of Patent: Jan. 22, 2008

(54) HIGHLY RELIABLE AND ZERO STATIC CURRENT START-UP CIRCUITS

(75) Inventor: Narasimhan Vasudevan, Los Angeles, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 11/252,679

(22) Filed: Oct. 18, 2005

(51) Int. Cl.
*G05F 3/04* (2006.01)

(52) U.S. Cl. ..... 327/539; 323/313

(58) Field of Classification Search ..... 327/530, 327/538, 539; 323/312–317
See application file for complete search history.

(56) References Cited

U.S. PATENT DOCUMENTS 4,709,165 A * 11/1987 Higuchi et al. ..... 327/97
4,857,823 A * 8/1989 Bitting ..... 323/314
5,087,830 A * 2/1992 Cave et al. ..... 327/539
6,018,235 A * 1/2000 Mikuni ..... 323/313
6,677,808 B1 * 1/2004 Sean et al. ..... 327/539
6,815,941 B2 * 11/2004 Butler ..... 323/313
6,992,489 B2 * 1/2006 Bhattacharya et al. ..... 324/522
7,019,584 B2 * 3/2006 Bartel et al. ..... 327/539
2004/0000944 A1 * 1/2004 Cho ..... 327/391
2005/0231270 A1 * 10/2005 Washburn ..... 327/539

* cited by examiner

*Primary Examiner*—N. Drew Richards
*Assistant Examiner*—Thomas J. Hiltunen
(74) *Attorney, Agent, or Firm*—William L. Paradice, III; Lois D. Cartier

(57) ABSTRACT

A bandgap reference voltage circuit includes a bandgap circuit, a start-up circuit, and a recovery circuit. Upon device power-on, the start-up circuit provides a start-up current to initialize the bandgap circuit to a valid state, during which the bandgap circuit generates a substantially constant bandgap reference voltage. Once the bandgap circuit is in the valid state, the start-up circuit turns itself off. If the bandgap reference voltage falls to a level that causes the bandgap circuit to enter an invalid state, the recovery circuit turns on and provides a recovery current to the bandgap circuit that returns the bandgap circuit to the valid state, after which the recovery circuit turns itself off.

15 Claims, 2 Drawing Sheets

HIGHLY RELIABLE AND ZERO STATIC CURRENT START-UP CIRCUITS

FIELD OF INVENTION

The present invention relates generally to integrated circuits, and more specifically to reducing power consumption for circuits that generate reference signals.

DESCRIPTION OF RELATED ART

When an integrated circuit (IC) device is powered-on, it is important that the device's internal logic is set to a known state to ensure proper operation. For example, if one or more latches power-up into an undesirable state, the device may not function properly. Thus, most IC devices include a power-on reset (POR) circuit that asserts a reset signal when a voltage supply is detected and then de-asserts the reset signal when the voltage supply has reached an acceptable level that is sufficient for the device's normal operation. When asserted, the reset signal is typically used to reset the device's internal logic to a known state. When de-asserted, the reset signal is typically used to terminate the reset operation and allow the device to commence normal operation. The POR circuit can also be used to assert the reset signal when the voltage supply falls below an acceptable level (e.g., during device power-down).

Similarly, for IC devices that include a bandgap reference voltage circuit, it is important that the bandgap circuit enters a valid state when the IC device is powered-on. As known in the art, a bandgap circuit may be used to generate a bandgap reference voltage Vbg that is relatively insensitive to process and temperature variations. Typically, a start-up circuit is used to ensure that the bandgap circuit not only enters a valid state upon device power-on but also remains in the valid state during normal operation of the IC device.

For example, FIG. 1 shows a prior art bandgap reference voltage circuit 100 of an IC device (not shown for simplicity) as including a bandgap circuit 110 and a start-up circuit 120. Bandgap circuit 110, which generates a bandgap reference voltage Vbg in a well-known manner at node N0, includes PMOS transistors 111-112, resistors R1-R3, an op-amp 113, and diode-connected bipolar junction (BJT) transistors 114-115. PMOS transistor 111 and resistor R1 are connected in series between a main voltage supply VDD and node A, and diode 114 is connected between node A and ground potential. PMOS transistor 112 and resistor R2 are connected in series between VDD and node B, and resistor R3 and diode 115 are connected in series between node B and ground potential. Op-amp 113, which is well-known, includes a first input terminal coupled to node A, a second input terminal coupled to node B, and an output terminal to provide a control signal CTRL to the gate of PMOS transistor 112. PMOS transistors 111-112 provide currents I1 and I2, respectively, to the bandgap resistor network R1-R3 to create voltages at nodes A and B. Op-amp 113 maintains a substantially constant value of Vbg by adjusting the voltage level of CTRL in response to the voltage differential between its input nodes A-B in a well-known manner. Diodes 114-115, which sink current from nodes A-B, respectively, typically have a negative temperature coefficient for voltage that balances the positive temperature coefficient of the voltage across the resistor network R1-R3. The values of R1-R3 and diode sizes are chosen to create a desired value of Vbg.

Start-up circuit 120 includes diode-connected PMOS transistors 121-122 and NMOS transistors 123-124 connected in series between VDD and ground potential. The gate of PMOS transistor 121 is coupled to the gate of PMOS transistor 111 of bandgap circuit 110. The gates of NMOS transistors 123-124 are coupled to an auxiliary voltage supply VCCAUX sufficient to maintain NMOS transistors 123-124 in conductive states during normal operation. As explained below, start-up circuit 120 initializes bandgap circuit 110 to a valid operational state upon power-on, and thereafter maintains bandgap circuit 110 in the valid state.

For example, when circuit 100 is powered-on, VDD increases and turns on PMOS transistor 121, which conducts a current I3 through transistors 122-124. The current I3 in start-up circuit 120 is mirrored as a bandgap start-up current I1 through PMOS transistor 111 of bandgap circuit 110. The start-up current I1 creates a voltage differential between nodes A-B and initializes op-amp 113 to an operational state. In response thereto, op-amp 113 turns on PMOS transistor 112 to provide a current I2 to the resistor network R1-R3. Thereafter, op-amp 113 adjusts the current I2 through transistor 112 (i.e., by adjusting CTRL) to minimize the voltage differential between nodes A-B, thereby maintaining a substantially constant value for Vbg.

During normal operation of the device, start-up circuit 120 remains enabled (e.g., operational) so that if bandgap circuit 110 enters an invalid or non-operational state, start-up circuit 120 is able to return bandgap circuit 110 to the valid state. For example, if the value of Vbg deviates significantly from its intended value, the gain of op-amp 113 may become to low for op-amp 113 to be fully operational, and thus unable to return Vbg to its intended value. Thus, start-up circuit 120 continually mirrors current I1 through transistor 111 to maintain Vbg within an acceptable range. When op-amp 113 is not operational, the current I1 causes the voltages at nodes A and B to rise. When the voltages at nodes A and B rise above a threshold level, op-amp 113 becomes fully functional and can take over the operation of adjusting the voltage of CTRL to control the value of Vbg. However, continually providing a static current I1 through transistor 111 (e.g., even when bandgap circuit 110 is in the valid state) may result in significant power dissipation that may render circuit 100 infeasible for many low-power applications. Further, if start-up circuit 120 were disabled to prevent static current flow during normal operation, start-up circuit 120 could not re-enable itself to provide a start-up current sufficient to re-initialize op-amp 113 to an operational state if bandgap circuit 110 enters an invalid state.

Thus, it would be desirable for a bandgap voltage reference circuit to include circuitry that initializes the bandgap circuit to a valid state, turns off when the bandgap circuit enters the valid state, and is able to return the bandgap circuit to the valid state if the bandgap circuit enters an invalid state during normal operation.

SUMMARY

A method and apparatus are disclosed that maintain a bandgap reference voltage circuit of an integrated circuit (IC) device in a valid state without providing static current while the bandgap reference voltage circuit remains in a valid state. In accordance with the present invention, a circuit for maintaining a bandgap reference voltage at a reference node of an IC device includes a bandgap circuit, a start-up circuit, and a recovery circuit. The bandgap circuit includes an op-amp having input terminals coupled to a resistor network and having an output terminal coupled to generate a control voltage. The start-up circuit and the recovery circuit each include an output coupled to the resistor network. Upon device power-on, the start-up circuit provides a start-up current to the bandgap circuit to initialize the op-amp to an operational state. Once the op-amp is operational, the bandgap circuit enters a valid state during which the op-amp maintains the bandgap reference voltage at a substantially constant level, and the start-up circuit turns itself off to reduce the start-up current to a negligible level. While the bandgap circuit is in the valid state, the recovery circuit is turned off and thus conducts a negligible current. Accordingly, while the bandgap circuit is in the valid state, neither the start-up circuit nor the recovery circuit conduct static current, thereby reducing power consumption over prior art techniques.

If the bandgap reference voltage falls to a level that is insufficient for the op-amp to remain operational but yet sufficient to maintain the startup circuit in its off state, which in turn causes the bandgap circuit to enter an invalid state, the recovery circuit turns on and provides a recovery current to the bandgap circuit. The recovery current increases the voltage at the op-amp's input terminals to re-initialize the op-amp to an operational state. Once operational, the op-amp returns the bandgap circuit to its valid state and again maintains the bandgap reference voltage at a substantially constant level. Once the bandgap circuit returns to the valid state, the recovery circuit turns off and ceases to provide the recovery current to the bandgap circuit.

BRIEF DESCRIPTION OF THE DRAWINGS

The features and advantages of the present invention are illustrated by way of example and are by no means intended to limit the scope of the present invention to the particular embodiments shown, and in which.

Like reference numerals refer to corresponding parts throughout the drawing figures.

DETAILED DESCRIPTION

The present invention is applicable to a variety of integrated circuits and systems. The present invention has been found to be particularly applicable and beneficial maintaining a bandgap reference voltage circuit in a valid state while minimizing power consumption. However, embodiments of the present invention may be useful for any circuit that requires a reliable start-up and/or recovery mechanism that maintains the circuit in a valid state while minimizing static current. In the following description, for purposes of explanation, specific nomenclature is set forth to provide a thorough understanding of the present invention. In other instances, well-known circuits and devices are shown in block diagram form to avoid obscuring the present invention. Further, the logic levels assigned to various signals in the description below are arbitrary, and thus can be modified (e.g., reversed polarity) as desired. Accordingly, the present invention is not to be construed as limited to specific examples described herein but rather includes within its scope all embodiments defined by the appended claims.

Figure 2:
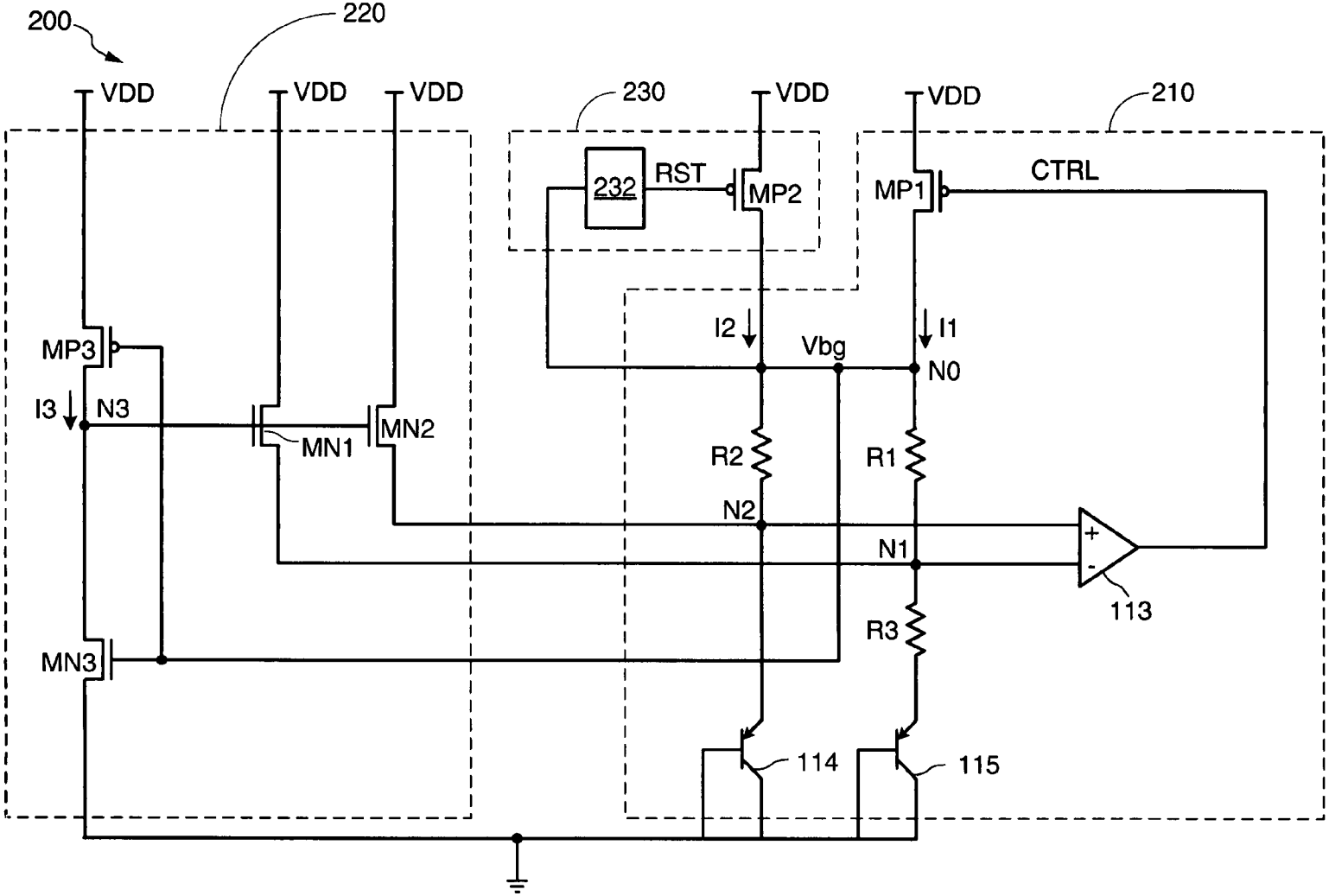
FIG. 2 is a circuit diagram of a bandgap reference voltage circuit in accordance with some embodiments of the present invention.

FIG. 2 shows a bandgap reference voltage circuit 200 for an IC device (not shown for simplicity) in accordance with some embodiments of the present invention. Circuit 200 includes a bandgap circuit 210, a start-up circuit 220, and a recovery circuit 230. Bandgap circuit 210, which generates a bandgap reference voltage Vbg at a reference node N0, includes PMOS transistor MP1, resistors R1-R3, op-amp 113, and diodes 114-115. PMOS transistor MP1 and resistor R1 are connected in series between VDD and node N1, and resistor R3 and diode 115 are connected in series between node N1 and ground potential. Resistor R2 is connected between nodes N0 and N2, and diode 114 is connected between node N2 and ground potential. Op-amp 113, which is well-known, includes a first input terminal coupled to node N1, a second input terminal coupled to node N2, and an output terminal to provide a control signal CTRL to the gate of PMOS transistor MP1. PMOS transistor MP1 provides a current I1 to the bandgap resistor network R1-R3 during normal operation of circuit 200. Op-amp 113 maintains a substantially constant value of Vbg by adjusting CTRL in response to the voltage differential between its input nodes N1-N2 to control current flow through transistor MP1. For some embodiments, diodes 114-115 have a negative temperature coefficient for voltage that balances the positive temperature coefficient of the voltage across the resistor network R1-R3. The values of R1-R3 and the sizes of diodes 114-115 are chosen to create a desired value of Vbg. For exemplary embodiments described herein, VDD is between approximately 1.2-1.5 volts, and Vbg is maintained at approximately 1.2 volts.

Start-up circuit 220 includes PMOS transistor MP3 and NMOS transistors MN1-MN3. Transistors MP3 and MN3 are connected in series between VDD and ground potential, and each have a gate coupled to Vbg. Transistor MN2 is connected between VDD and node N2, and transistor MN1 is connected between VDD and node N1. The gates of transistors MN1-MN2, which form a source-follower circuit, are coupled to a control node N3 between transistors MP3 and MN3. For some embodiments, PMOS transistor MP3 is a relatively weak transistor, and NMOS transistor MN3 is a relatively strong transistor so that NMOS transistor MN3 is able to over-power PMOS transistor MP3 when their gate voltages are somewhat equal.

Although a specific embodiment is shown in FIG. 2, for other embodiments, transistors MN1-MN2 can be connected to any suitable tap points of the resistor network R1-R3, or alternately to node N0. For other embodiments, one of transistors MN1-MN2 may be eliminated.

Recovery circuit 230 includes PMOS transistor MP2 and a trigger circuit 232. PMOS transistor MP2 is connected in series between VDD and node N0, and has a gate to receive a reset signal RST from an output of trigger circuit 232, which in turn includes an input to receive Vbg. As explained below, trigger circuit 232 prevents PMOS transistor MP2 from providing a current to bandgap resistor network R1-R3 when bandgap circuit 210 is in a valid state, and causes PMOS transistor MP2 to provide a recovery current I2 to the bandgap resistor network R1-R3 when bandgap circuit 210 enters an invalid state. For some embodiments, trigger circuit 232 is a well-known Schmitt trigger, although for other embodiments, other circuit architectures may be used to implement trigger circuit 232.

Although a specific embodiment is shown in FIG. 2, for other embodiments, the input to trigger circuit 232 can be connected to any suitable tap point of the resistor network R1-R3, or alternately to either node N1 or node N2.

An exemplary operation of circuit 200 is as follows. When the IC device is powered-on, Vbg is initially at or near ground potential, which maintains NMOS transistor MN3 in a non-conductive state. During power-on, VDD begins to increase and turns on PMOS transistor MP3, which conducts a current I3 that charges control node N3 toward VDD.

When the voltage at node N3 exceeds the threshold voltage VT of NMOS transistors MN1-MN2, transistors MN1-MN2 turn on and provide a start-up current to nodes N1-N2, respectively, of bandgap circuit 210. This start-up current increases the voltages at nodes N1-N2 to a level sufficient to initialize op-amp 113 to an operational state. Once op-amp 113 is operational, bandgap circuit 210 enters a valid state during which op-amp 113 maintains a substantially constant value for Vbg by controlling the current I1 through transistor MP1 by adjusting the voltage level of CTRL in response to the voltage differential between nodes N1-N2. For the exemplary embodiments described herein, Vbg is maintained at approximately 1.2 volts. The operation of op-amp 113 for maintaining a substantially constant value for Vbg is well-known, and therefore is not discussed further herein.

Figure 1:
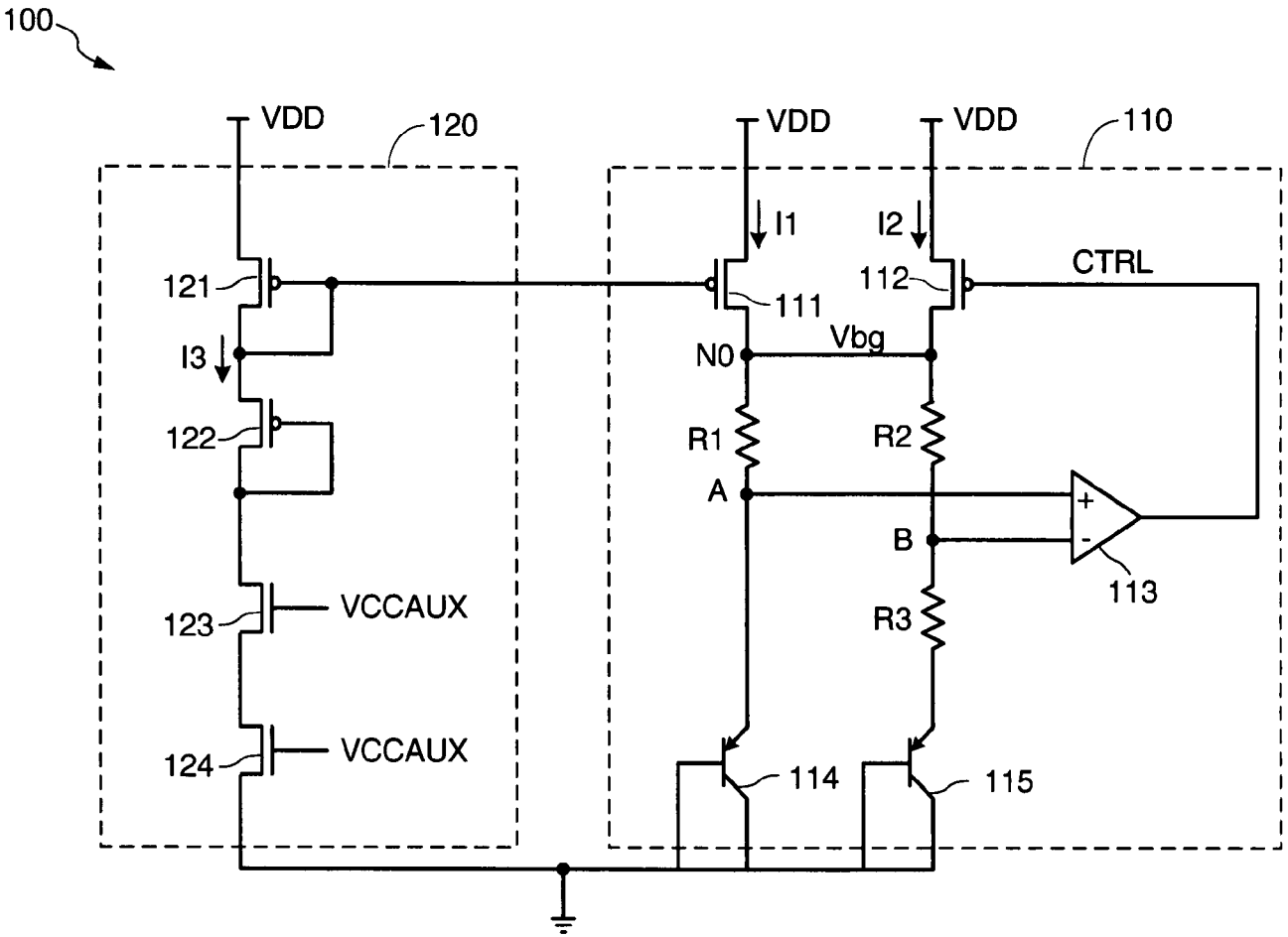
FIG. 1 (Prior Art)
FIG. 1 is a circuit diagram of a prior art bandgap reference voltage circuit.

When bandgap circuit 210 enters the valid state (e.g., when op-amp 113 is operational and maintains Vbg at the desired level), start-up circuit 220 turns itself off and ceases to provide the start-up current to bandgap circuit 210. For example, when Vbg increases to a voltage that is greater than the VT of NMOS transistor MN3 (e.g., when Vbg is greater than approximately 0.4-0.5 volts), transistor MN3 turns on and pulls the voltage at control node N3 low towards ground potential. When the voltage at control node N3 falls below the VT of NMOS transistors MN1-MN2, transistors MN1-MN2 turn off and reduce the start-up current provided to bandgap circuit 210 to a negligible level (e.g., to approximately zero). In this manner, start-up circuit 220 does not generate static current while bandgap circuit 210 is in the valid state, thereby reducing power consumption over prior art circuits such as, for example, circuit 100 of FIG. 1.

Note that while bandgap circuit 210 is in the valid state, trigger circuit 232 de-asserts RST (e.g., to logic high) to maintain PMOS transistor MP2 in a non-conductive state so that recovery circuit 230 does not generate any static current. Thus, while bandgap circuit 210 is in the valid state, only its transistor MP1 provides current to resistor network R1-R3 to charge reference node N0 for generating Vbg.

While bandgap circuit 210 is in the valid state, fluctuations in the value of Vbg (e.g., resulting from noise, ground bounce, power supply fluctuations, and the like) may reduce the gain of op-amp 113 to a level that is insufficient for op-amp 113 to operate properly. For example, if the value of Vbg drops below approximately 0.9 volts, the resulting reduction in the gain of op-amp 113 may cause op-amp 113 to be unable to return Vbg to its intended value (e.g., to approximately 1.2 volts), which causes bandgap circuit 210 to enter an invalid state. Although start-up circuit 220 may be activated to provide a start-up current to bandgap circuit 210 when Vbg falls to a POR level sufficient to turn on NMOS transistors MN1-MN2 (i.e., by turning on PMOS transistor MP3 and turning off NMOS transistor MN3), which for the exemplary embodiment described herein occurs when Vbg is at or below approximately 0.7 volts, allowing bandgap circuit 210 to remain in an invalid state until Vbg decreases to at or below the VT of NMOS pull-down transistor MN3 (which would enable start-up circuit 210 to provide a start-up current to bandgap circuit 210) is not desirable. For example, if Vbg inadvertently stays between the VT of NMOS transistor MN3 and the minimum voltage for op-amp 113 to be operational, bandgap circuit 210 may remain in the invalid state for long periods of time (perhaps indefinitely).

Accordingly, as bandgap circuit 210 enters the invalid state, recovery circuit 230 turns on and provides a recovery current I2 to bandgap circuit 210 to re-initialize op-amp 113 to an operational state, thereby returning bandgap circuit 210 to the valid state. For example, when Vbg drops below a first trigger voltage (e.g., approximately 0.8 volts), trigger circuit 232 asserts RST (e.g., to logic low) to turn on transistor MP2, which in turn provides a recovery current I2 to bandgap circuit 210. The recovery current I2 increases the voltages at nodes N1-N2, which in turn re-initializes op-amp 113 to an operational state. Once op-amp 113 is operational, bandgap circuit 210 returns to the valid state, op-amp 113 maintains Vbg at the desired level (e.g., approximately 1.2 volts), and recovery circuit 230 turns itself off to eliminate static current I2 when bandgap circuit 210 is in the valid state. For example, as the value of Vbg approaches a second trigger voltage (e.g., approximately 1.2 volts), trigger circuit 232 de-asserts RST (e.g., to logic high) to turn off PMOS transistor MP2 and thereby reduce the recovery current I2 to a negligible level (e.g., to a zero current). In this manner, recovery circuit 230 provides a static current I2 to bandgap circuit 210 only when necessary to return bandgap circuit 210 to the valid state from the valid state.

While particular embodiments of the present invention have been shown and described, it will be obvious to those skilled in the art that changes and modifications may be made without departing from this invention in its broader aspects, and therefore, the appended claims are to encompass within their scope all such changes and modifications as fall within the true spirit and scope of this invention. More specifically, although specific circuit implementations are disclosed above for start-up-circuit 220 and recovery circuit 230, other suitable circuit configurations may be used. For example, start-up circuit 220 may utilize any circuit architecture that allows start-up circuit 220 to provide a start-up current sufficient to initialize op-amp 113 to an operational state upon device power-on, and that automatically turns off and ceases to provide the start-up current once the op-amp is operational. Similarly, recovery circuit 230 may utilize any circuit architecture that allows recovery circuit 230 to, upon the bandgap circuit entering an invalid state, to provide a recovery current that re-initializes op-amp 113 to an operational state and thereby returns the bandgap circuit to the valid state, and thereafter ceases to provide a recovery current when bandgap circuit 210 returns to the valid state.

What is claimed is:

1. A circuit for generating a bandgap reference voltage for an integrated circuit (IC) device, the circuit comprising:

a bandgap circuit including an op-amp coupled to a resistor network, wherein the bandgap circuit is configured to maintain the bandgap reference voltage at a specified level;

a start-up circuit having an output coupled to the resistor network, wherein upon power-on of the device the start-up circuit turns on and provides a start-up current to initialize the bandgap circuit to a valid state, and when the bandgap circuit enters the valid state, the start-up circuit turns off and reduces the start-up current to a negligible level; and a recovery circuit having an output coupled to the resistor network, wherein if the bandgap circuit enters an invalid state, the recovery circuit turns on and provides a recovery current to the bandgap circuit to return the bandgap circuit to the valid state, wherein the recovery current is different from the start-up current, and wherein the start-up circuit comprises:

a first PMOS transistor coupled between a voltage supply and a control node, and having a gate to receive the bandgap reference voltage;

a first NMOS transistor coupled between the control node and ground potential, and having a gate to receive the bandgap reference voltage; and a source-follower circuit coupled between the voltage supply and the resistor network and having a control terminal coupled to the control node.

2. The circuit of claim 1, wherein the bandgap circuit enters the valid state when the op-amp becomes operational.

3. The circuit of claim 1, wherein the source-follower circuit comprises:

a second NMOS transistor coupled between the voltage supply and a first input terminal of the op-amp and having a gate coupled to the control node.

4. The circuit of claim 3, wherein the source-follower circuit further comprises:

a third NMOS transistor coupled between the voltage supply and a second input terminal of the op-amp and having a gate coupled to the control node.

5. The circuit of claim 1, wherein the bandgap circuit enters the invalid state when the op-amp becomes non-operational.

6. The circuit of claim 1, wherein the recovery circuit turns off and reduces the recovery current to a negligible level when the bandgap circuit returns to the valid state.

7. The circuit of claim 1, wherein the recovery circuit comprises:

a PMOS transistor coupled between a voltage supply and the resistor network, and having a gate; and a trigger circuit having an input to receive the bandgap reference voltage and having an output coupled to the gate of the PMOS transistor.

8. The circuit of claim 7, wherein the trigger circuit turns on the PMOS transistor when the bandgap reference voltage falls below a first trigger voltage and turns off the PMOS transistor when the bandgap reference voltage exceeds a second trigger voltage that is greater than the first trigger voltage.

9. A circuit for maintaining a bandgap reference voltage at a reference node of an integrated circuit (IC) device, the circuit comprising:

a bandgap circuit, comprising:

a first PMOS transistor coupled between a voltage supply and a reference node;

a resistor network coupled between the reference node and ground potential; and an op-amp having input terminals coupled to the resistor network and having an output terminal coupled to a gate of the first PMOS transistor; and a start-up circuit, comprising:

a second PMOS transistor coupled between the voltage supply and a control node, and having a gate to receive the bandgap reference voltage;

a first NMOS transistor coupled between the control node and ground potential, and having a gate to receive the bandgap reference voltage; and a source-follower circuit coupled between the voltage supply and the resistor network and having a control terminal coupled to the control node.

10. The circuit of claim 9, wherein upon power-on of the device the start-up circuit is enabled to provide a start-up current to initialize the bandgap circuit to a valid state, and is thereafter disabled to provide a negligible current to the bandgap circuit when the bandgap circuit is in the valid state.

11. The circuit of claim 10, further comprising a recovery circuit configured to be enabled when the bandgap circuit enters an invalid state and to be disabled when the bandgap circuit enters the valid state.

12. The circuit of claim 11, wherein the recovery circuit provides a recovery current to the bandgap circuit when the recovery circuit is enabled, and provides a negligible current to the bandgap circuit when the recovery circuit is disabled.

13. The circuit of claim 9, further including a recovery circuit comprising:

a third PMOS transistor coupled between the voltage supply and the reference node, and having a gate; and a trigger circuit having an input coupled to the reference node and having an output coupled to the gate of the third PMOS transistor.

14. The circuit of claim 13, wherein the trigger circuit turns off the third PMOS transistor when the bandgap circuit is in a valid state and turns on the PMOS transistor when the bandgap circuit is in an invalid state.

15. The circuit of claim 13, wherein the recovery circuit and the start-up circuit conduct negligible current when the bandgap circuit is in the valid state.

* * * * *